United States Patent [19]

Flick et al.

[11] Patent Number: 4,483,030

[45] Date of Patent: Nov. 20, 1984

[54] AIR PAD

[75] Inventors: Roland E. Flick; Ronald D. Wortman, both of West Seneca; Krstin Fotevski, Blasdell, all of N.Y.; John Whitney, Dorado Beach, P.R.X

[73] Assignee: Medisearch PR, Inc., Guayama, P.R.X

[21] Appl. No.: 374,079

[22] Filed: May 3, 1982

[51] Int. Cl.[3] ..... A61G 7/04; A47C 27/08

[52] U.S. Cl. ..... 5/458; 5/455; 156/274.6; 156/290; 156/292

[58] Field of Search ..... 5/449, 450, 455, 456, 5/457, 458, 441, 451

[56] References Cited

U.S. PATENT DOCUMENTS

| | | | |
|---|---|---|---|
| 1,625,810 | 4/1927 | Krichbaum | 5/458 |
| 2,318,492 | 5/1943 | Johnson | 5/458 |
| 2,703,770 | 3/1955 | Meltzer | 5/458 |

*Primary Examiner*—Alexander Grosz

[57] ABSTRACT

An inflatable air pad, or fluid impervious pad, is provided having three layers, the top and bottom being joined together to form an enclosed envelope with a middle layer interposed between defining an upper and lower chamber. Fluid is allowed to flow from one side of the middle layer to the other, such that there is uniform pressure throughout. A sealable port is provided in the enclosed envelope for the injection of fluid under pressure. The middle layer is attached to the top layer in a series of seals or attachment points in a rectangular array and is similarly sealed to the bottom layer in a similar rectangular pattern; however, the two patterns are positioned 180 degrees out of phase with each other. These patterns form a series of small cushion areas in the upper and lower chambers respectively and the cushion areas are nested within each other on an offset basis. The individual seals or attachment points are preferably square and are oriented such that lines of maximum stress in the sealed layers are perpendicular to the sides of the square pattern. A number of further seals are formed within the body of the pad, specifically, a preferred pad is divided into three sections with a series of seal lines joining all three layers running lengthwise of the pad parallel to the sides of the pad, thus creating a middle section and two side sections. Interruptions are provided in those seals so that fluid can flow between the sections and the pressure remain uniform throughout.

7 Claims, 5 Drawing Figures

FIG. 4.
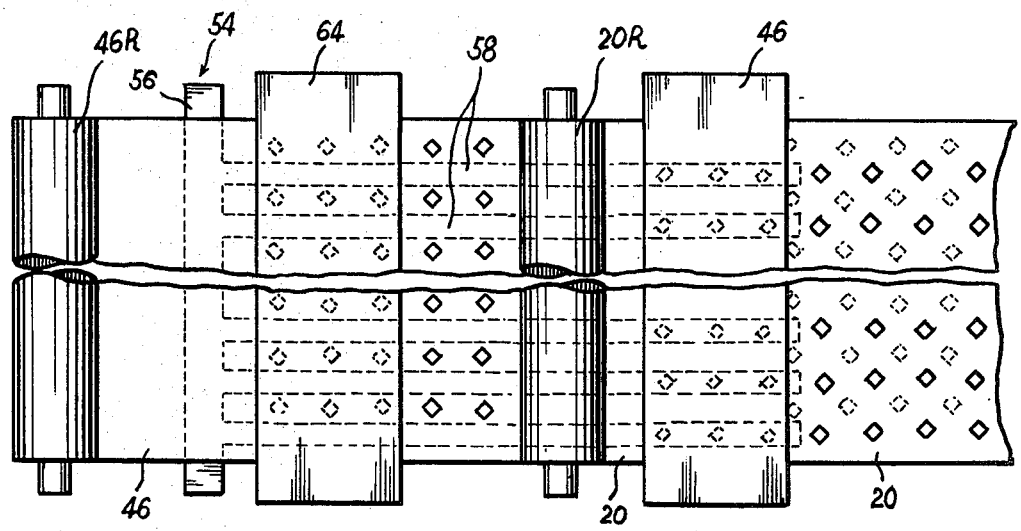
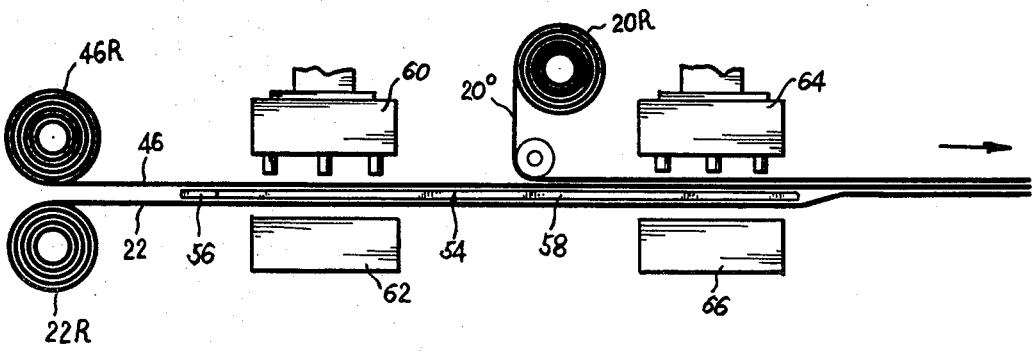
FIG. 5.

AIR PAD

The invention relates to fluid-impervious pads for use on beds and is intended to provide a support for the human body with minimum pressure being applied to the body where it contacts the pad.

Relatively inactive, bedridden patients in hospitals and nursing homes have a high incidence of the development of decubitus ulcers or bedsores. It is generally recognized that this phenomenon is caused by relatively high pressure experienced at crucial points on the patient's body. The problem is particularly aggrevated with increasing degrees of immobility of the patient, when the patient is thin and at those points on the body where body weight is concentrated but the thickness of the flesh between the skeletal structure and the supporting surface is minimum.

A number of alternatives have been suggested and are in use to minimize the bedsore problem. Included among these are alternating pressure pads, water beds, soft foam pads, mud and jel pads and low pressure inflatable air pads. Although the last proposal has held great promise, success with the use of stable air pads has not been achieved for a number of reasons. We have particularly attacked these problems and have produced a new static air pad design of substantially improved performance characteristics.

Many static air pads of the past have required too high an internal pressure to prevent the patient from "bottoming" on the pad. This has produced high pressure on the most sensitive points of the patient's body.

The creep problem has been a major reason for the lack of success of static air pads in health care. As the material in the pad stretches, the volume of the pad increases geometrically and the pressure decreases. When the pressure decrease is sufficient for the pad to bottom, its usefulness is destroyed. We have determined that relatively modest stretching of the plastic film material used to make air pads produces relatively major increases in volume. Specifically, considering an idealized spherical model, a one percent material stretch will produce a three percent increase in volume. If one starts with a pad inflated to a pressure of 26 mmHg and the volume of the pad increases by only one percent due to material creep, the pressure will decrease from 26 mmHg to 18.2 mmHg. That thirty percent decrease in pressure from only a one percent increase in volume is illustrative of the need to formulate a pad construction which displays minimum creep.

The creep problem previously led the health care personnel to overinflate the pads in the first instance to avoid the need for constantly refilling the pad and still required many further fillings to prevent bottoming out of the pad. This activity further increased the pressure applied to the patient's body, either by the pad being overfilled in the first instance or it bottoming out, and also required too much repetitive attention by the hospital and nursing home attendants.

Prior pad constructions have also had problems in association with what we call the hammock effect, in which the upper surface of the pad is pulled in tension, thus presenting a supporting surface to the patient's body which is harder than that which would be encountered solely based upon the fluid pressure within the pad but can still allow the pad to bottom out if the hammock length is large compared to the height of the pad.

The closest prior art we know is U.S. Pat. No. 2,703,770 which shows a static airpad having similarities to our pad. However, the inventor of the pad illustrated in that patent neither understood nor attempted to solve the creep problem, nor the hammock effect problem. As such, he did not incorporate or even suggest use of the square seals which we use nor the intermediate seal lines for minimizing the hammock effect. As such, the airpad shown in U.S. Pat. No. 2,703,770 did not produce a satisfactory, stable inflatable pad for hospital and nursing home use and it did not give a suggestion of the direction in which to proceed in order to produce that result.

Recognizing these and other failings of the prior art constructions, it was and is our object to provide an improved static air pad for use on hospital beds and the like which provides improved performance characteristics. It is also our object to eliminate the disadvantages encountered in the prior art.

It is a further object of our invention to provide a static air pad in which the internal pressures may be maintained in the range of 17 to 28 millimeters of mercury (mmHg). It is also a goal of our invention to minimize the negative aspects of the hammock effect, thereby to further reduce pressure on a patient supported on the pad.

It is still a further object of the present invention to provide a static air pad which may simply and efficiently be filled, without the requirement for multiple further fillings, by formulating a design for such pad which minimizes the creep effect normally associated with such pads.

Generally, it is the object of our invention to provide an improved air pad for use in hospitals, nursimg homes and the like.

In accordance with one presently preferred embodiment of our invention, there is provided an air pad made up of three sheets of material, the first and second sheets forming the top and bottom layer of a completely closed envelope with the third sheet positioned between the two as a middle layer. The middle layer defines upper and lower chambers between it and the top and bottom layers of the pad, respectively. The middle layer is constructed so that fluid may freely flow between the upper and lower chambers thereby to maintain equal pressures throughout the pad. The middle layer is secured to the upper layer at a series of attachment points arranged in a rectangular orientation, thus, when the pad is pressurized, a series of small cushion areas are formed between the upper and middle layer. Similarly, the middle layer is connected to the lower layer with a second and similar series of attachment points. However, the first and second series of attachment points are offset from each other 180 degrees. In each chamber, there are formed a series of small cushion areas and those cushion areas offset from each other 180 degrees. There are further formed two lines of seals running generally parallel to the longer sides of the pad and spaced inwardly from those sides, thus forming a center section of the pad and two side sections; this reduces the length of material in the upper and lower layers which is independent and thus reduces the negative aspects of the hammock effect. Similar seals through all three pad layers may be made in the transverse direction. A sealable port is provided into the pad such that the pad may be charged to a desired pressure and sealed.

The above brief description, as well as further features and advantages of our invention, will be best appreciated by giving consideration to the following description with reference to the drawings, wherein:

FIG. 4 is a plan view of a portion of the equipment and the process employed for the manufacture of the pad FIG. 1; and FIG. 5 is an elevational view of the equipment and process illustrated in FIG. 4.

Figure 1:
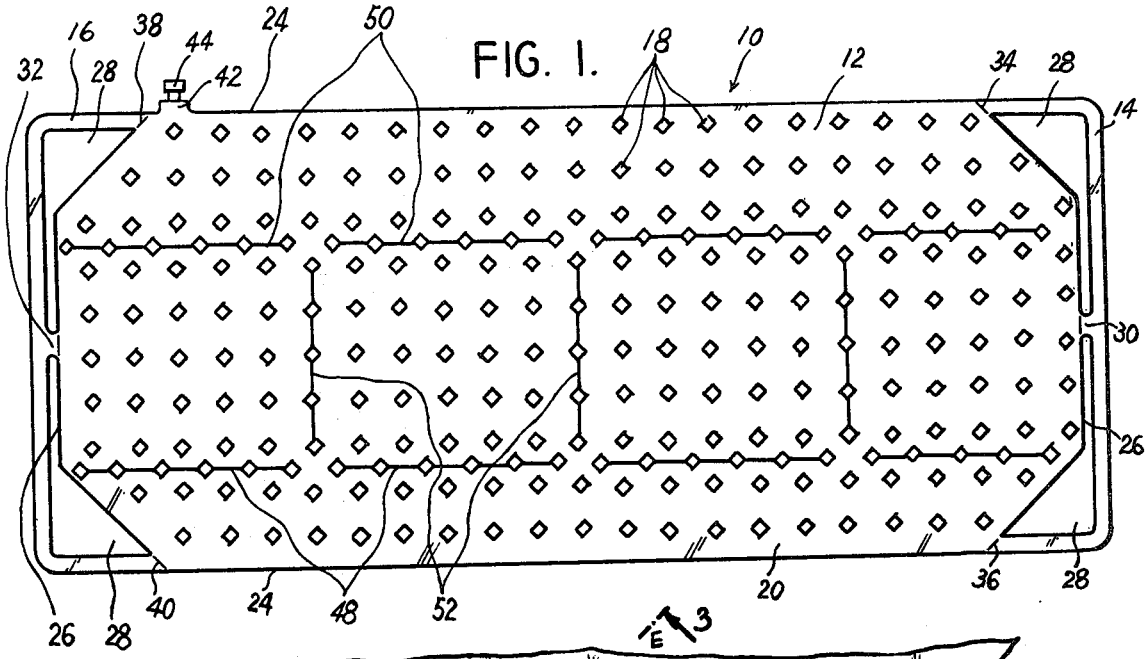
FIG. 1 is an overall plan view of an air pad or fluid mattress in accordance with the present invention.

Referring now to FIG. 1 of the drawings, a three-layer inflatable pad 10 has a main body portion 12 forming the major portion of the pad and securement strap assemblies 14, 16 at the two ends of the pad. When viewed from the exterior, the main body portion 12 of the pad 10 displays a pattern of square seals, the individual seals being identified by by numeral 18 which are arranged in a uniform rectangular array in which the individual seals or attachment points are spaced from each other approximately on four inch centers. The rectangular array of individual seals 18 visible on the top layer 20 is also found on the opposite side of the pad 10, on the bottom layer 22, but on that side the array is offset by 180 degrees from the first array in a manner to be described in greater detail below.

Figure 2:
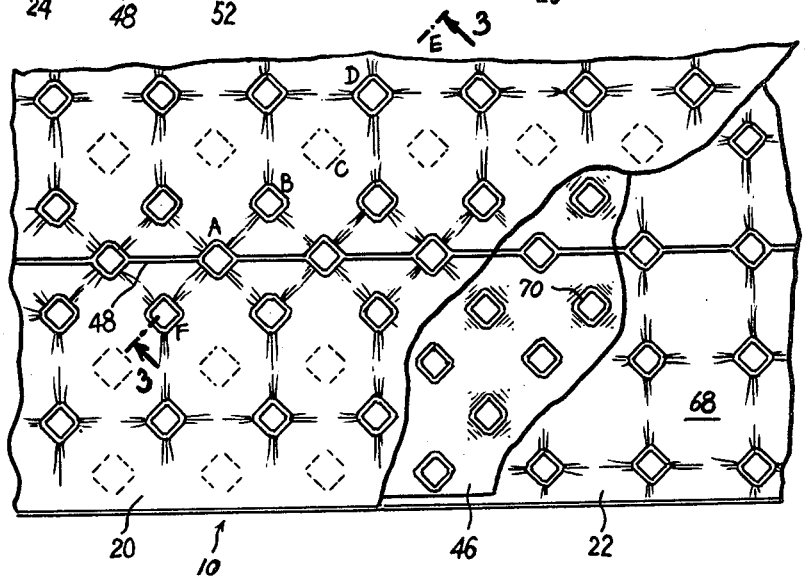
FIG. 2 is an enlarged plan view of a portion of the pad shown in FIG. 1 with portions of the top and middle layer of the pad broken away to show the multilayered construction and sealing arrangement of the pad.

The external envelope of the main body portion 12 of the pad 10 is formed of an upper layer of film material 20 and a lower layer of film material 22 (not seen in FIG. 1, see FIG. 2). The top and bottom layers 20, 22 are heat sealed together around the entire perimeter of the main body portion 12, specifically along the side edges 24 and the end edges 26. The main portion 12 of pad 10 is generally rectangular except that the corners of the ends of the pad are eliminated for convenience.

The securement strap assemblies 14, 16 are formed of the same sheets of film material which form the layers 20, 22, 46 The film is die cut to produce the openings 28 which both separate the material of the strap assemblies 14, 16 from the main body 12 of the pad and also form the cutoff corners of the pad. A bridge 30, 32 at each end of the pad is left holding the center portions of each of the strap assemblies 14, 16 to the main body portion 12 of the pad 10 such that each of the two assemblies 14, 16 actually comprise two separate straps, one at each of the corners of the pad 10. These straps are used by simply stretching them down over the corners of the typical bed matress such that the pad is held securely in place at three locations at each end of the pad, namely the points indicated at 30, 32, 34, 36, 38 and 40.

A filling port 42 is formed in the main body 12 of pad 10 and an appropriate fitting 44 is attached which provides a means for the injection of air under controlled pressure into the pad 10 and for appropriate sealing of the pad to prevent the escape of the air.

As best seen in FIG. 2, in addition to the top layer 20 and the bottom layer 22 which form the fluid-impervious envelope for the main body 12 of the pad 10, there is a third layer or middle layer 46 which forms a major structural element of the pad. The middle layer 46 is also formed of heat sealable material and is joined by the seals 18 both to the upper layer 20 and the lower layer 22 of the pad. The middle layer 46 does not impede the flow of fluid between the upper chamber above it and the lower chamber below it; thus, pressure within the pad remains uniform throughout. In this embodiment, the film forming the middle layer 46 is narrower than the pad body so that the middle layer is not sealed to the top and bottom layers along the sides 24 of the pad. Alternatively, the middle layer may be formed with slits or holes throughout to permit free fluid flow. A further description of the function of middle layer 46 will be given below.

All three layers 20, 22 and 46 of the pad 10 are joined together by a series of longitudinal seal lines 48 and 50 which run parallel to the longer edges 24 of the pad and which, in this particular embodiment, are composed of four separate seal lines with spaces therebetween such that the contained fluid can flow freely through those longitudinal seal lines 48, 50 to maintain pressure uniformity throughout the pad. Similarly, there are transverse seal lines 52 formed parallel to the ends 26 of the pad 10 which also connect all three pad layers. As will be described below, the longitudinal seal lines 48 and the transverse seal lines 52 are each separately useful in reducing the negative aspects of the hammock effect.

Prior to a further description of the construction of the pad 10, reference will be made to FIGS. 4 and 5 for a description of the process by which the pad is made and the apparatus which performs that process. We believe an understanding of the process will help in understanding and appreciating the resulting structure.

Reference should be made to FIGS. 4 and 5. At a first station, indicated as I, the material which will form the bottom layer 22 of the pad 10 is supplied in a first roll 22R and the material which will form the middle layer 46 is supplied in a second roll 46R. The two layers of film material 46 and 22 are brought together in station II of the apparatus and operation. Initially, these layers are separated by a barrier assembly 54 which consists of a stationary barrier bridge 56 secured to the frame of the machine and a plurality of longitudinally extended barrier fingers 58 which extend through stations II, III and IV as shown in FIGS. 4 and 5. The barrier assembly 54 is essentially inert at station II and therefore will not be further described at this point. At station II, there is a radio frequency sealer comprising a radio frequency head 60 and base 62. Extending from the head 60 are three rows (it could be more or less) of individual square shaped sealing dies. When the head 60 and the base 62 move toward each other, the film layers 46 and 22 are brought together and radio frequency energy causes them to fuse forming a seal in the shape of the sealing dies. Because the sealing dies of the radio frequency head 60 at station II are located in the spaces between the fingers 58 of the barrier assembly 54, the barrier assembly is of no function at that point. When the head 60 and base 62 move toward each other, they bring the film layers together for sealing in the open spaces between the fingers 58. Immediately to the right of radio frequency head 60 in FIG. 4 are shown two rows of seals which were made at station II; it can be seen that those seals are in line with the open spaces between the barrier fingers 58.

At station III, a third roll of material 20R is mounted which provides the film for the upper layer 20 of the three-layer pad. This layer of film is brought into contact with the middle layer 46 and the composite three-layer sandwich is then moved longitudinally into station IV of the apparatus.

At station IV there is provided a second radio frequency sealer comprising the radio frequency head 64 and its associated base 66. The head 64 is the same as the head 60; however, it is offset transversely in comparison to the position of head 60 such that the individual square seals 18 formed by the second head fall on a line bisecting the distance between the seals formed by the first head 60. This location is also the location of the center of the barrier fingers 58. Thus, when sealing head 64 in station IV is brought into contact with film 20, it is at a location immediately over the barrier fingers 58 such that a heat seal is formed only between the top layer 20 and the middle layer 46; no seal is provided with the bottom layer 22 at that point because the barrier fingers 58 separate the middle layer 46 from the bottom layer 22 at those locations. Since the barrier assembly 54 is constructed of brass, aluminum or some other appropriate conductive metal, and is at ground potential, there is no possibility of sealing with the bottom layer 22 nor of any interference with the smooth flow of film material through that station.

The result of the process is that two separate series of seals are made in the triple layer package comprising the bottom layer 22, the middle layer 46 and the upper layer 20. One of those layers is shown in FIG. 4 in solid line configuration, i.e., the series of seals which is between the upper layer 20 and the middle layer 46, and the other series of seals is shown in dotted line configuration, i.e., the series of seals between the middle layer 46 and the lower layer 22. It should be pointed out that at this point in the assembly of the pad 10, the three layers of the material from which the pad will be formed are joined together, but at no point is there a direct seal as between the upper layer 20 and the bottom layer 22; it is only that they are each sealed to the middle layer 46. Furthermore, it will be seen that the relationship between the two sets of seals is one in which they are 180 degrees offset from each other or 180 degrees out of phase. Specifically, if one examines any seal in one of the series, it will be surrounded by four seals of the other series, each at a uniform distance from the first seal and each at a 90° spacing around the first seal. Another way of stating the same thing is that if one examines the lines that can be drawn through the various seal locations, one will find alternatively seals to the upper surface interspersed with seals to the lower surface, or if the line one chooses to examine contains only seals between the middle layer and one of the top or bottom layers, the next parallel line will be seals between the middle of the opposite layer and the other of the top and bottom layer.

The individual seals 18 are best seen in FIG. 2 and are generally square in total configuration although the corners of each square are rounded to avoid any points of high stress concentration. The area that is actually sealed is a band about $\frac{1}{8}$ inches in width forming the perimeter of the (rounded) square which is about one to one and five eighths inches across. The flat faces of each square are oriented facing into the individual cushion area formed by each group of four seals. At its simplest, this is illustrated in the lower right-hand corner of FIG. 2 where only the bottom layer 22 of the pad 10 is shown. Referring to the generally square area designated by the numeral 68, it will be understood that the area is defined by the four surrounding seals 18 which join the layers 22 to the middle layer 46 (not shown at this point). Idealized versions of pucker or fold lines are used in FIG. 2 and generally define the squarish shape of the cushion area. At the center of cushion area 68, the film material 22 is pushed downwardly in its great amount and thus it is along lines running between opposite corners of that cushion area that the film material is under highest stress. That is also the case for film material of the middle layer 46. This can be visualized by considering the upper left seal 18 of the cushion area 68 in FIG. 2, recognizing that the lower layer 22 is attached to the middle layer 46 at that point and that the middle layer then is pulled at an upward angle to its adjacent attachment point with the upper layer 20. That is designated by the numeral 70 in FIG. 2. It will be understood that the film of the middle layer 46 receives its maximum stress along the line between those two seals which is perpendicular to the flat faces of the seals. Thus, when visualizing a three-dimensional representation of what is shown in two dimensions in FIG. 2, it will be appreciated that the middle layer 46 extends sharply downwardly in all four diagonal directions from the square seal 70 to the four surrounding square seals with the lower layer 22. Similarly, where the middle layer 46 is secured to the lower layer 22, that middle layer extends sharply upwardly in all four surrounding directions to the adjacent points where the middle layer 46 is sealed to the upper layer 20. In that portion of FIG. 2 which shows the middle layer 46, those square seals 18 which are attached to the upper layer 20 are shown with small shadow lines around the seals, whereas those which are attached to the lower layer 22 do not show any markings around the seal lines. Therefore, the maximum stress and tension on the film material making up the various layers of the pad 10 are in a direction perpendicular to the flat sides of the seals 18. As such, the forces are uniformly distributed over as large an area as possible (essentially the entire size of the seal), thereby to minimize the stress and thus minimize the creep which would be exhibited by the pad.

Figure 3:
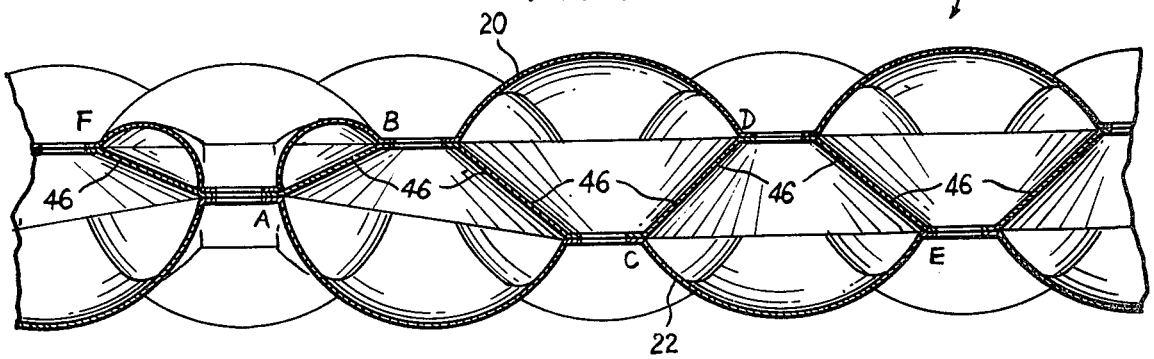
FIG. 3 is a sectional view taken along the line 3—3 of FIG. 2 looking in the direction of the arrows illlustrating an idealized view of the configuration taken by the various layers of the pad when inflated.

FIG. 3 is an idealized and partially schematic cross sectional view of the pad taken through the line 3—3, looking in the direction of the arrows and illustrating, on its right-hand side, the configuration taken by the three layers of film material in the uninterrupted field areas of the pad 10 and, on its left-hand side, the configuration assumed where there is one of the longitudinally or transverse seal lines 48, 50 and 52, in this case the longitudinal seal line 48.

For convenience in understanding and visualizing the actual three-dimensional reality of the two two-dimensional drawings shown in FIGS. 2 and 3, we have labeled corresponding points in each of these two drawings with the same letters so that one can follow the relative high, median and low points along the section line 3—3 shown in FIG. 2 when observing and studying FIG. 3. Specifically, we have labeled as A the square seal along seal line 48 in which all three pad layers 20, 46 and 22 are joined together; that same designation appears in FIG. 3. Progressing upwardly and toward the right along the line 3—3 in FIG. 2, the next square seal has been labeled B and that seal is between the upper layer 20 and the middle layer 46. The next seal along the line 3—3 has been labeled C and that is a seal between the lower layer 22 and the middle layer 46. The next seal along the line 3—3 is labeled D and that is a seal between the upper layer 20 and the middle layer 46, and finally, the next seal labeled E (actually off the drawing in FIG. 2) is labeled E and that is a seal between the lower layer 22 and the middle layer 46. In the other direction, progressing downwardly and to the left along the line 3—3 in FIG. 2, the next seal adjacent seal A has been labeled F and that is a seal between the upper film layer 20 and the intermediate layer 46. Each of those seals 18 have been similarly designated in FIG. 3. It will be readily seen that in FIG. 3 that the intermediary or middle layer 46 undergoes a complicated surface variation with twice as many seal points than occur in the upper and lower layers 20 and 22. Following a straight section line through the pad 10 such as FIG. 3, one sees that the intermediary layer 46 goes upwardly to its seal point with the upper layer and then downwardly to its seal point with the lower layer and back up again and down again continuously. On the other hand, the upper and lower layers are supported against significant longitudinal or sideward stress and form rather soft and generally spherical pillow portions.

By constructing a three-layer pad with offset seal patterns in the manner described, and with the individual seals being formed as squares whose flat faces are positioned perpendicular to the lines of maximum tension in the film layers, stress has been reduced to a minimum, thereby reducing the phenomenon colloquially known as creep, thereby minimizing the increase in volume previously encountered in inflatable pads and thereby minimizing the need to reinflate the pads when the pressure decays because of the stretching of the film.

The longitudinal and/or transverse weld lines, such as the lines 48, 50 and 52, function to increase the useful aspects of the hammock or diaphragm stress or, stating it alternatively, to achieve the same degree of positive aid in supporting the patient's body by a minimal amount of tension (hammock stress) in the upper layer of the pad. It has been found that the diaphragm stress also produces the same sort of deformation, increase in volume and therefore lowering of pressures that were previously described. It has also been found that the hammock effect is at its worst when the length of the hammock is greatest. When there is a relatively small length of the idealized hammock, i.e., when the dimension of the particular pad section in function at a given moment is close to the height of the pad, the hammock effect is at its most useful and, conversely, when the pad dimension in use is great compared to pad height, the hammock effect is at its worst. When the hammock section is very wide, bottoming is quick to occur because the physical parameters are such that the load will push downwardly a greater amount and, furthermore, the pad will tend to curl upwardly at its ends and actually bend, thus allowing the load bearing portions in the center of the pad to migrate further down and, possibly, bottom out. Thus, smaller hammock dimensions are a positive additions to air pads of this type and the embodiment shown, particularly the longitudinal seal lines 48, 50, have been shown to be particularly advantageous in this manner. The seal lines 48, 50 essentially create a working pad width, for hammock effect considerations, equal to the distance between the lines 48 and 50, thus reducing the hammock dimension by about one half without producing any offsetting negative result.

By the incorporation of the features described above, we have constructed pads which have been initially inflated to the desired 28 mmHg and require little or no further inflation. In some instances, after just one additional inflation to adjust for the initial creep which occurs in the first minutes of use of a new pad, no further inflation was needed for periods as long as several weeks and thereafter no further inflation was needed for months. This is in marked contrast to prior constructions where, in addition to being difficult to adequately support the patient on a pressure as low as 28 mmHg, multiple additional inflation was required to prevent the patient from causing the pad to bottom.

The foregoing is a description of one presently preferred embodiment of our invention. The design parameters have been set out in a manner which we believe is understandable. Variations of designs can be made changing this particular preferred embodiment in major and minor manners without departing from the spirit and scope of our invention.

What is claimed is:

1. A fluid tight pad for supporting a body at minimum pressure on those portions of the body in contact with the pad comprising a first layer of fluid-impervious material forming a top outer layer of the pad, a second layer of fluid-impervious material forming a bottom layer, a third layer of material forming a middle layer with an upper chamber above it and a lower chamber below it, said top and bottom layers joined together around the periphery of said pad forming a fully air-impervious envelope, selectively sealable port means in said envelope for injecting fluid therein, said middle layer not precluding the flow of fluid from one side thereof to the other such that the pressure in the upper and lower chambers are equal, said middle layer being attached to said top layer at a plurality of attachment points in a first rectangular array and attached to said bottom layer at a plurality of attachment points in a second and similar rectangular array, said first and second retangular arrays being offset from each other 180 degrees forming a series of small square cushion areas in said upper and lower chambers in rectangular patterns which are overlapping and offset from each other by 180 degrees, and said first, second and third layers being sealed together along at least one line within the perimeter of said pad.

2. A fluid tight pad for supporting a body at minimum pressure on those portions of the body in contact with the pad comprising a first layer of fluid-impervious material forming a top outer layer of the pad, a second layer of fluid-impervious material forming a bottom layer, a third layer of material forming a middle layer with an upper chamber above it and a lower chamber below it, said top and bottom layers joined together around the periphery of said pad forming a fully air-impervious envelope, selectively sealable port means in said envelope for injecting fluid therein, said middle layer not precluding the flow of fluid from one side thereof to the other such that the pressure in the upper and lower chambers are equal, said middle layer being attached to said top layer at a plurality of attachment points in a first rectangular array and attached to said bottom layer at a plurality of attachment points in a second and similar rectangular array, said first and second rectangular arrays being offset from each other 180 degrees forming a series of small square cushion areas in said upper and lower chambers in rectangular patterns which are overlapping and offset from each other by 180 degrees.

3. A fluid tight pad in accordance with claim 1 or 2 wherein said plurality of attachment points are generally square shaped seals having generally straight side faces and being oriented with said straight side faces at approximately 45 degrees to the sides of said small square cushion areas.

4. A pad in accordance with claim 3, wherein said first, second and third layers are sealed together along two longitudinal lines dividing said pad into a central section and two side sections, said pad having communication between said sections for maintenance of uniform pressure among said sections.

5. A pad in accordance with claim 3, wherein said generally square shaped seals are between one inch and one and five eighths inches from side to side.

6. A pad in accordance with claim 3, wherein said pluarlity of attachment points in each of said first and second arrays are spaced on approximately four inch centers in said arrays when said pad is uninflated.

7. A pad in accordance with claim 3 having securement straps at the four corners thereof formed of the material of said top and bottom layers, each of said straps joined to said pad at a first location on one side of said pad, said straps being of a length and flexibility to be positioned around and under one of the corners of a rectangular mattress.

* * * * *